United States Patent [19]

Feest et al.

[11] Patent Number: 4,928,745

[45] Date of Patent: May 29, 1990

[54] METAL MATRIX COMPOSITE MANUFACTURE

[75] Inventors: Eric A. Feest, Didcot, England; Peter F. Chesney, Swansea; Jeffrey S. Coombs, Neath, both of Wales

[73] Assignee: United Kingdom Atomic Energy Authority, London, England

[21] Appl. No.: 843,687

[22] Filed: Mar. 25, 1986

[30] Foreign Application Priority Data

Mar. 25, 1985 [GB] United Kingdom ..... 8507674

[51] Int. Cl.[5] ..... B22D 23/00

[52] U.S. Cl. ..... 164/46; 164/97

[58] Field of Search ..... 164/46, 97, 122, 133, 164/900

[56] References Cited

U.S. PATENT DOCUMENTS 4,420,031 12/1983 Frykendahl ..... 164/46 X

FOREIGN PATENT DOCUMENTS 1379261 1/1975 United Kingdom .

1472939 5/1977 United Kingdom .

2115014B 9/1983 United Kingdom ..... 164/46

OTHER PUBLICATIONS

Perry, R. H. et al. Perry's Chemical Engineners' Handbook, 6th Edition, 1984, pp. 20–58.

Singer, A. R. E. et al., Metal Matrix-Composites Produced By Spray Co-Deposition, Paper 15 (1983), Powder Metallurgy Group Meeting of the Metals Society, Edinburgh, Oct. 24–26, 1983.

*Primary Examiner*—Nicholas P. Godici

*Assistant Examiner*—J. Reed Batten, Jr.

*Attorney, Agent, or Firm*—Larson and Taylor

[57] ABSTRACT

A metal, e.g. in the form of a shaped article, is made by atomizing a stream of molten metal and directing the atomized stream at a collecting surface to form a deposit of the metal. Fine, solid particulate material of different composition from the metal, e.g., nonmetallic particles, and of mean particle size less than 20 micrometers, preferably less than 10 micrometers, is applied to the stream or spray so that it becomes incorporated into the deposit. The particulate material is applied by generating a fluidized bed thereof and feeding it from the bed into the stream or spray. Uniform dispersion of material such as SiC at a high volume percentage (e.g. greater than 15%) may be achieved.

3 Claims, 1 Drawing Sheet

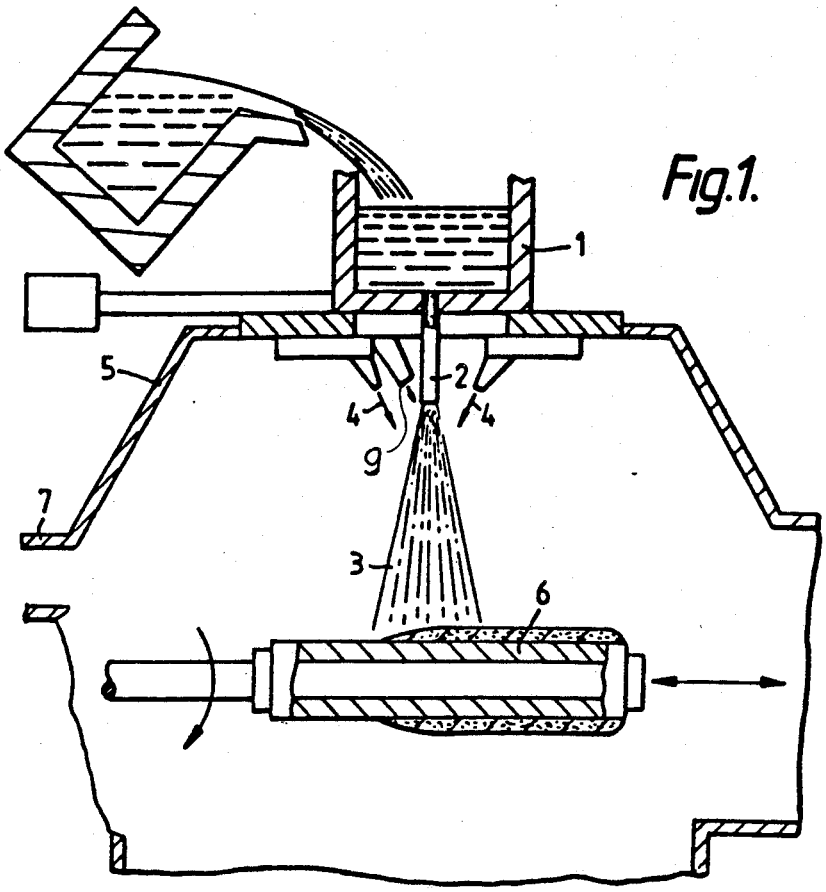
Fig.1.
Fig.2.
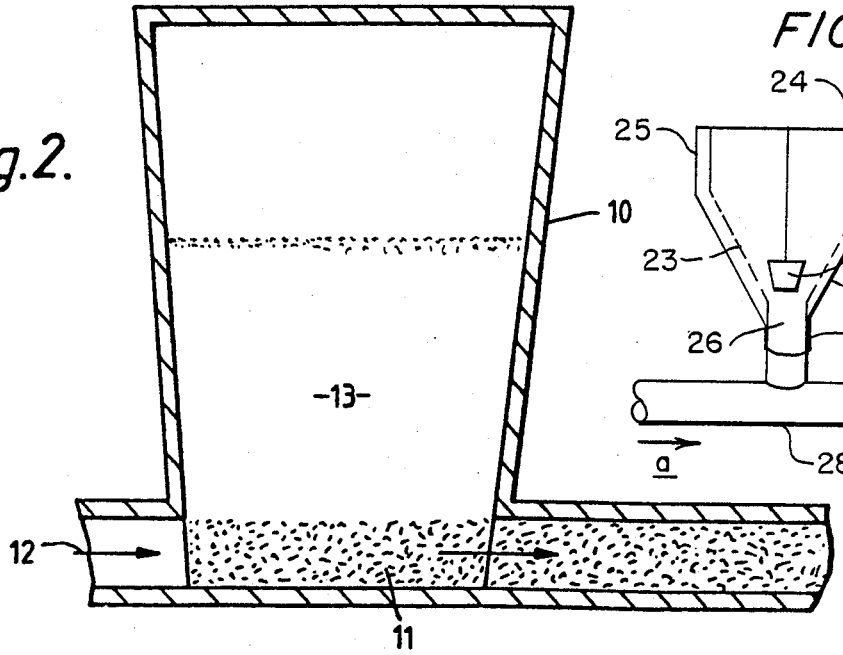
FIG. 3
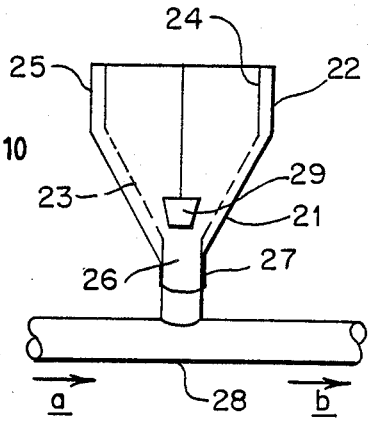

METAL MATRIX COMPOSITE MANUFACTURE

This invention relates to the manufacture of metal matrix composites.

UK Patent Specification No. 1 379 261 describes a method for manufacturing a shaped precision article from molten metal or molten metal alloy, comprising directing an atomised stream of molten metal or molten metal alloy onto a collecting surface to form a deposit, then directly working the deposit on the collecting surface by means of a die to form a precision metal or metal alloy article of a desired shape, and subsequently removing the precision shaped article from the collecting surface. The specification also describes an apparatus for manufacturing shaped precision articles from molten metal or molten metal alloy.

UK Patent Specification No. 1 472 939 describes a related process and in particular a method of manufacturing from liquid metal an individually shaped workable preform which is substantially non-particulate in nature, which is free from segregation, over 95% dense and possesses a substantially uniformly distributed, closed to atmosphere internal pore structure comprising the steps of atomising a stream of molten metal to form a spray of hot metal particles by subjecting the stream of molten metal to high velocity, relatively cold gas directed at the stream, directing the spray of particles into a shaped mould to form within the mould a discrete spray-deposited preform of desired dimensions, the temperature and flow rate of the gas being determined so as to extract a critical and controlled amount of heat from the atomised metal particles both during flight and on deposition, whereby the solidification of the preform is not dependant on the temperature and/or the thermal properties of the mould.

Each of the above-mentioned specifications states that, if desired, metallic and/or non-metallic powders, fibre, filaments or whiskers can be incorporated in the sprayed deposit during the deposition operation.

This invention is concerned with the utilisation of the methods described in the above-mentioned specifications to the production of metal matrix composites wherein a uniform dispersion of fine particulate material is incorporated into the metal, the particulate material being of a different composition from the metal.

The incorporation of coarse particulate material (i.e. 75 micrometres to 120 micrometres) into metals is described by A.R.E. Singer and S. Ozbek in "Metal Matrix Composites Produced by Spray Co-Deposition", Paper 15 (1983) presented at the Powder Metallurgy Group Meeting of the Metals Society held in Edinburgh from 24–26 October 1983. The paper describes injecting second phase particles (non-metallic or insoluble particles/fibres) into an atomised stream of molten matrix material in such a way that a homogenous mixture is formed during flight, for example the injection of SiC or $Al_2O_3$ into Al alloy matrices. However, in the art, fine particulate material is considered to be difficult to handle and hitherto expensive multi-stage powder metallurgy methods have been used in the incorporation thereof into metal matrices, e.g. to produce materials for use in aerospace and land transport applications.

In one aspect, the invention provides a method of making a metal matrix composite material comprising the steps of atomising a stream of molten metal to form a spray of hot metal particles by subjecting the stream to relatively cold gas directed at the stream, generating a fluidised bed of fine, solid particles of mean particle size less than 20 micrometres and of a material of different composition from the metal, applying material from the bed to the stream or spray, and depositing the metal having said fine particles incorporated therein.

The method of the invention may be used to prepare metal matrix composites having uniformly dispersed therein a high volume percentage (e.g. in the range of 0.5–50%, typically 10–30%) of material of different composition from the metal. The material preferably has a particle size of less than 10 micrometres. The fine particulate material is for enhancing one or more physical properties of the metal matrix, e.g. for increasing the specific modulus of the material.

The metal used may be any elemental metal or alloy that can be melted and atomised and examples include aluminium, aluminium base alloys, steels, nickel base alloys, cobalt, copper and titanium base alloys.

The fine, solid particles may be metallic or non-metallic and may be in various physical forms (such as a powder or chopped fibres) and sizes. Specific examples of such non-metallic particles are those of silicon carbide and alumina. Silicon carbide in an aluminium alloy matrix can increase its specific modulus and possibly its high temperature strength.

The particulate solid material may be injected at room temperature or at temperatures up to the superheat of the metal being sprayed and may be fed into the molten metal in a number of regions. It is, however, preferred to feed the material into the so-called 'atomising zone' immediately after the molten metal begins to break up into a spray. The atomising gas may be argon or nitrogen normally at ambient temperature but always at a temperature less than the melting point of the metal being sprayed.

The invention may be used to produce types of deposit such as bar, strip, plate, discs or intricately shaped articles. The deposit may be in the form of a shaped article or a semi-finished product or ingot or may be worked to form an article of desired shape and/or consolidated by methods known in the art such as hot deformation processing, e.g. by extrusion, hot isostatic pressing or hot rolling followed by cold rolling.

Several ways of carrying out the invention will now be described by way of example only. Reference will be made to the accompanying drawings, in which FIG. 1 is a diagrammatic view of apparatus for carrying out the invention, FIG. 2 is a diagrammatic view of one form of injection apparatus, and FIG. 3 is a modification of the apparatus shown in FIG. 2, In FIG. 1, apparatus for the formation of metal or metal alloy deposits comprises a tundish 1 in which metal is held above its liquidus temperature. The tundish 1 has a bottom opening so that the molten metal may issue in a stream 2 downwardly from the tundish 1 to be converted into a spray of particles 3 by atomising gas jets 4 within a spray chamber 5, the spray chamber 5 first having been purged with inert gas so that the pick-up of oxygen is minimized. The sprayed particles are deposited upon a suitable collecting surface 6, in this case a mandrel to form a tubular deposit as will be explained.

In order to supply powder material to the injection nozzle 9, a reservoir 10 for powder is provided which is fluidised at the bottom 11 by the injection gas stream introduced at 12 - see FIG. 2. In this way the powder material 13 to be injected is both fluidised and carried to the injection nozzle 9 as desired by the same injection gas stream.

In FIG. 3 a more detailed alternative of fluidising apparatus is disclosed which comprises a closed outer fluidised bed container 21 having an inner container 22 consisting of a perforated conical lower portion 23 and an upper cylindrical portion 24. A passageway 25 for fluidising gas is defined between the outer container 21 and the inner container 22. The lower end of the inner container 22 has an exit orifice 26 communication via an exit pipe 27 with a conduit 28 for carrier gas. The orifice 26 is provided with a moveable plug 29 for controlling egress of material from the inner container 22.

The feed apparatus is connected to spray apparatus such as described in FIG. 1 thereof and is used for conveying the particulate material, thereto.

In operation of the overall apparatus and refering particularly to FIGS. 1 and 3 of the accompanying drawings, the inner container 22 is loaded with particulate material and fluidising gas is passed into the passageway 25, thence to enter the inner container 22 via its perforated lower portion 23 and generate a fluidised bed of the particulate material therein. Carrier gas is passed along the conduit 28 in the direction shown by the arrow a and the plug 29 adjusted to allow fluidised material to pass through the orifice 26, along the exit pipe 27 and into the conduit 28 to be conveyed therefrom by the carrier gas in the shown by the arrow b and thence into the spray chamber.

At the same time, a molten metal spray issues stream 2 from the tundish 1 into the spray chamber 5 and is atomised by gas issuing from the jets 4. Particulate material from conduit 28 is co-sprayed with the atomised stream and incorporated into the molten metal. A solidified deposit comprising a coherent deposit of a composite of the metal and a reinforcing material, is collected on the collecting surface 6.

In FIGS. 1 and 3, as indicated above, the spray 3 is directed on to a rotating mandrel collecting surface 6 to form a tubular spray deposit, the collecting surface, during formation of the deposit being moved so as to effect a reciprocating movement in accordance with the arrows in the figures or a slow-traverse through the spray. Once formed, the tubular deposit is removed from the collecting surface. Subsequently the tubular deposit can be further processed by cutting, machining, forging, extrusion, rolling, thixoworking or combinations of the process to produce tubes, rings or other components or semi-finished products. However, as already indicated herein, the invention may be used to produce any type of spray deposit, for example bar, strip, plate, discs or intricately shaped articles.

The invention is illustrated in the following example:

EXAMPLE

The above-described apparatus was used to prepare samples of composite materials. The tundish was in the form of an induction heated, high alumina crucible and the spraying was carried out from a fixed jet. The collecting surface comprised a rotating tubular refractory substrate which was either oscillated along its axis or slowly traversed in one direction along its axis.

The general procedure was as follows. The crucible was loaded with a metal charge (3–4 Kg) of a 5083 Al alloy (British Standard designation; nominal composition by weight Al - 4.5 Mg - 0.7 Cu - 0.15 Cr) and its lid sealed to give controlled overpressure. The fluidised bed container was loaded with SiC reinforcing material powder (particle size≃9 micrometres) and also sealed. The charge was melted by MF induction heating and after about 3 minutes the atomising gas was switched on. At about 3½ minutes, molten metal poured into the atomiser and formed a spray (flow rate 10 Kg/min); the fluidising gas was then passed to fluidise the powder (0.2–0.3 bar) which was injected into the atomising zone of the spray chamber (flow rate 2.5 Kg/min). A small overpressure of nitrogen was applied to the crucible and adjusted continuously to maintain a constant metal flow rate into the atomiser throughout the spraying period (20 seconds). A deposit of a composite material formed on the rotating substrate. The material was removed for examination after cooling and found to be very dense, substantially homogeneous with good wetting and adherence of the SiC into the metal, and to contain about 20% by volume of SiC.

The composite material was then extruded to give a 1" × ⅜" rectangular section billet starting from a composite material billet of 3" diameter.

We claim:

1. A method of making a metal matrix composite material comprising the steps of atomizing a stream of molten metal to form a spray of hot metal particles by subjecting the stream to relatively cold gas directed at the stream, generating a fluidized bed of fine, solid particles of mean particle size less than 10 micrometers and of a ceramic material, allowing fluidized particles to issue from the bed, conveying said particles issuing from the bed by means of a carrier gas and applying the conveyed particles issuing from the bed to the stream or spray, and depositing the metal having said fine particles incorporated therein.

2. A method according to claim 1 wherein the metal is aluminum, an aluminum base alloy, a steel, a nickel base alloy, cobalt, copper or a titanium base alloy.

3. A method according to claim 1 wherein the particles are of silicon carbide or alumina.

* * * * *